US011100908B2

(12) United States Patent
Saito et al.

(10) Patent No.: US 11,100,908 B2
(45) Date of Patent: Aug. 24, 2021

(54) KEYBOARD AND KEYBOARD COMPONENT

(71) Applicant: Yamaha Corporation, Shizuoka (JP)

(72) Inventors: Shunsuke Saito, Shizuoka (JP); Ken Takahashi, Shizuoka (JP); Ichiro Osuga, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/906,890

(22) Filed: Jun. 19, 2020

(65) Prior Publication Data

US 2021/0012760 A1 Jan. 14, 2021

(30) Foreign Application Priority Data

Jul. 8, 2019 (JP) ..... JP2019-126802

(51) Int. Cl.
*G10H 1/34* (2006.01)
*G10C 3/12* (2006.01)

(52) U.S. Cl.
CPC ..... *G10H 1/346* (2013.01); *G10C 3/125* (2013.01); *G10H 2230/065* (2013.01)

(58) Field of Classification Search
CPC ... G10H 1/346; G10H 2230/065; G10C 3/125
See application file for complete search history.

(56) References Cited

U.S. PATENT DOCUMENTS 6,191,351 B1 * 2/2001 Niitsuma ..... G10H 1/346 84/423 R
6,438,445 B1 * 8/2002 Yoshida ..... G05B 19/40937 700/173
6,653,542 B2 * 11/2003 Suzuki ..... G10C 3/12 84/423 R
6,995,308 B2 * 2/2006 Nishida ..... G10H 1/346 84/238
7,141,729 B2 * 11/2006 Uno ..... G10H 1/346 84/236
7,709,718 B2 * 5/2010 Osuga ..... G10H 1/346 84/423 R
7,750,222 B2 * 7/2010 Osuga ..... G10H 1/346 84/423 R (Continued)

FOREIGN PATENT DOCUMENTS

JP 3680687 B2 8/2005

*Primary Examiner* — Robert W Horn
(74) *Attorney, Agent, or Firm* — Global IP Counselors, LLP

(57) ABSTRACT

A keyboard includes a frame and a plurality of mass bodies. The mass bodies are arranged in parallel to each other. Each of the mass bodies is pivotally supported to pivot about a pivot fulcrum with respect to the frame. The mass bodies are at least one of a plurality of keys configured to be directly operated, a plurality of interlocking members configured to pivot in conjunction with a corresponding one of the plurality of keys, embedded members in the plurality of keys or embedded members in the plurality of interlocking members. At least some of the mass bodies include notched portions being arranged in order from a pitch, which is equal to or greater than a lowest pitch, to a highest pitch. The notched portions are different from each other in at least one of size, position, or distance from the pivot fulcrum.

14 Claims, 10 Drawing Sheets

(56) References Cited

U.S. PATENT DOCUMENTS

| | | | | |
|---|---|---|---|---|
| 8,350,140 | B2 * | 1/2013 | Taniguchi | G10H 1/34 84/423 R |
| 8,445,765 | B2 * | 5/2013 | Sawada | G10H 1/346 84/439 |
| 8,481,841 | B2 * | 7/2013 | Shimoda | G10H 1/346 84/744 |
| 8,686,266 | B2 * | 4/2014 | Taniguchi | G10H 1/346 84/433 |
| 8,766,075 | B2 * | 7/2014 | Ishida | G10C 3/12 84/423 R |
| 8,766,076 | B2 * | 7/2014 | Ishida | G10H 1/346 84/433 |
| 8,921,676 | B2 * | 12/2014 | Iwase | G10H 1/346 84/433 |
| 8,969,698 | B1 * | 3/2015 | Suzuki | G10C 3/12 84/436 |
| 9,177,535 | B2 * | 11/2015 | Suzuki | G10C 3/18 |
| 9,384,715 | B2 * | 7/2016 | Taniguchi | G10C 3/18 |
| 9,495,940 | B2 * | 11/2016 | Hoshino | G10C 3/18 |
| 9,899,014 | B2 * | 2/2018 | Nishimura | G10H 1/346 |
| 10,115,382 | B2 * | 10/2018 | Nishimura | G10C 3/12 |
| 10,418,003 | B2 * | 9/2019 | Taniguchi | G10C 3/18 |
| 10,424,281 | B2 * | 9/2019 | Taniguchi | G10H 1/346 |
| 10,546,567 | B2 * | 1/2020 | Kuno | G10H 1/346 |
| 10,885,884 | B2 * | 1/2021 | Takahashi | G10C 3/12 |
| 2001/0037723 | A1 | 11/2001 | Nishida et al. | |
| 2020/0019219 | A1 * | 1/2020 | Palmer | H04R 7/24 |
| 2021/0012760 | A1 * | 1/2021 | Saito | G10C 3/125 |

* cited by examiner

KEYBOARD AND KEYBOARD COMPONENT

CROSS-REFERENCE TO RELATED APPLICATIONS

This application claims priority to Japanese Patent Application No. 2019-126802, filed on Jul. 8, 2019. The entire disclosure of Japanese Patent Application No. 2019-126802 is hereby incorporated herein by reference.

BACKGROUND

Technical Field

The present invention relates to a keyboard and a keyboard component having a plurality of mass bodies arranged parallel to each other.

Background Information

A keyboard in which a plurality of mass bodies that pivot in conjunction with corresponding keys are arranged parallel to each other in order to impart inertia to an operation of keys on the keyboard is known from the prior art. A keyboard of this type is known in which a weight is attached to each of the main bodies of a plurality of mass bodies, each weight having a hollow portion and the same outer edge shape (Japanese Patent No. 3680687). In this device, the volume of the hollow portion of the weight to be attached is individually set to thereby vary the moment of inertia of each mass body and to achieve key scaling with a tactile sense of the keying operation. That is, in the keyboard of Japanese Patent No. 3680687, a plurality of types of weight thicknesses and a plurality of types of hole sizes formed in the weights are provided, to thereby realize weights of varying mass by means of combinations of thicknesses and hole sizes.

SUMMARY

However, in the keyboard of Japanese Patent No. 3680687, it is necessary to manufacture each weight by managing the combination of thickness and hole size. Specifically, increasing the number of keys that are included in the keyboard necessitates greater manufacturing precision to set the moment of inertia of each mass body to the desired accuracy across the entire sound range. Manufacturing the mass bodies one at a time, on the other hand, would ensure precision but at reduced production efficiency. Thus, there is the problem that efficiently manufacturing various types of mass bodies having different inertia is not a simple matter.

One object of this disclosure is to provide a keyboard that can facilitate the manufacture of a plurality of mass bodies having different moments of inertia.

In one aspect of this disclosure, a keyboard comprises a frame and a plurality of mass bodies. The plurality of mass bodies are arranged in parallel to each other, and each of the plurality of mass bodies is pivotally supported to pivot about a pivot fulcrum with respect to the frame. The plurality of mass bodies are at least one of a plurality of keys configured to be directly operated, a plurality of interlocking members configured to pivot in conjunction with a corresponding one of the plurality of keys, embedded members in the plurality of keys or embedded members in the plurality of interlocking members. At least some of the plurality of mass bodies include notched portions being arranged in order from a pitch, which is equal to or greater than a lowest pitch, to a highest pitch. The notched portions are different from each other in at least one of size, position, or distance from the pivot fulcrum.

In another aspect of this disclosure, a keyboard comprises a frame and a plurality of mass bodies. The plurality of mass bodies are arranged in parallel to each other, and each of the plurality of mass bodies is pivotally supported to pivot about a pivot fulcrum with respect to the frame. The plurality of mass bodies are at least one of a plurality of keys configured to be directly operated or a plurality of interlocking members configured to pivot in conjunction with a corresponding one of the plurality of keys. The plurality of mass bodies are divided into different areas classified according to key type or sound range, each of the plurality of mass bodies has a unique portion and a common portion, the unique portions have shapes that are different from each other between the different areas but identical within a same one of the different areas, and the common portions have shapes that are identical to each other in the different areas except for if a notched portion is provided in the common portions. At least some of the plurality of mass bodies have notched portions within the same one of the different areas being arranged in order from a pitch, which is equal to or greater than a lowest pitch of the same one of the different areas, to a highest pitch of the same one of the different areas. The notched portions of the plurality of mass bodies within the same one of the different areas are configured such that the notched portions are aligned to form a continuous path that is not parallel to an arrangement direction in a state in which the plurality of mass bodies within the same one of the different areas are removed from the frame and arranged parallel to each other side by side in the arrangement direction with either positions of the common portions being aligned or the pivot fulcrum being concentric among the plurality of mass bodies within the same one of the different areas.

In another aspect of this disclosure, a keyboard component comprises a plurality of mass bodies, which are at least one of a plurality of keys configured to be directly operated, a plurality of interlocking members configured to pivot in conjunction with a corresponding one of the plurality of keys, embedded members in the plurality of keys or embedded members in the plurality interlocking members. The plurality of mass bodies are divided into different areas classified according to key type or sound range, each of the plurality of mass bodies has a unique portion and a common portion, the unique portions have shapes that are different from each other between the different areas but identical within a same one of the different areas, and the common portions have shapes that are identical to each other in the different areas except for if a notched portion is provided in the common portions. At least some of the plurality of mass bodies have notched portions within the same one of the different areas being arranged in order from a pitch, which is equal to or greater than a lowest pitch of the same one of the different areas, to a highest pitch of the same one of the different areas. The notched portions of the plurality of mass bodies within the same one of the different areas are configured such that a side surface defining a contour of a notch shape for each of the notched portions is not parallel to an arrangement direction in a state in which the plurality of mass bodies within the same one of the different areas are arranged parallel to each other side by side in the arrangement direction with either positions of the common portions being aligned or the pivot fulcrum being concentric among the plurality of mass bodies within the same one of the different areas.

According to one aspect of this disclosure, it is possible to facilitate the manufacture of a plurality of mass bodies having different moments of inertia.

DETAILED DESCRIPTION OF EMBODIMENTS

Selected embodiments will now be explained with reference to the drawings. It will be apparent to those skilled in the field from this disclosure that the following descriptions of the embodiments are provided for illustration only and not for the purpose of limiting the invention as defined by the appended claims and their equivalents.

First Embodiment

Figure 1:
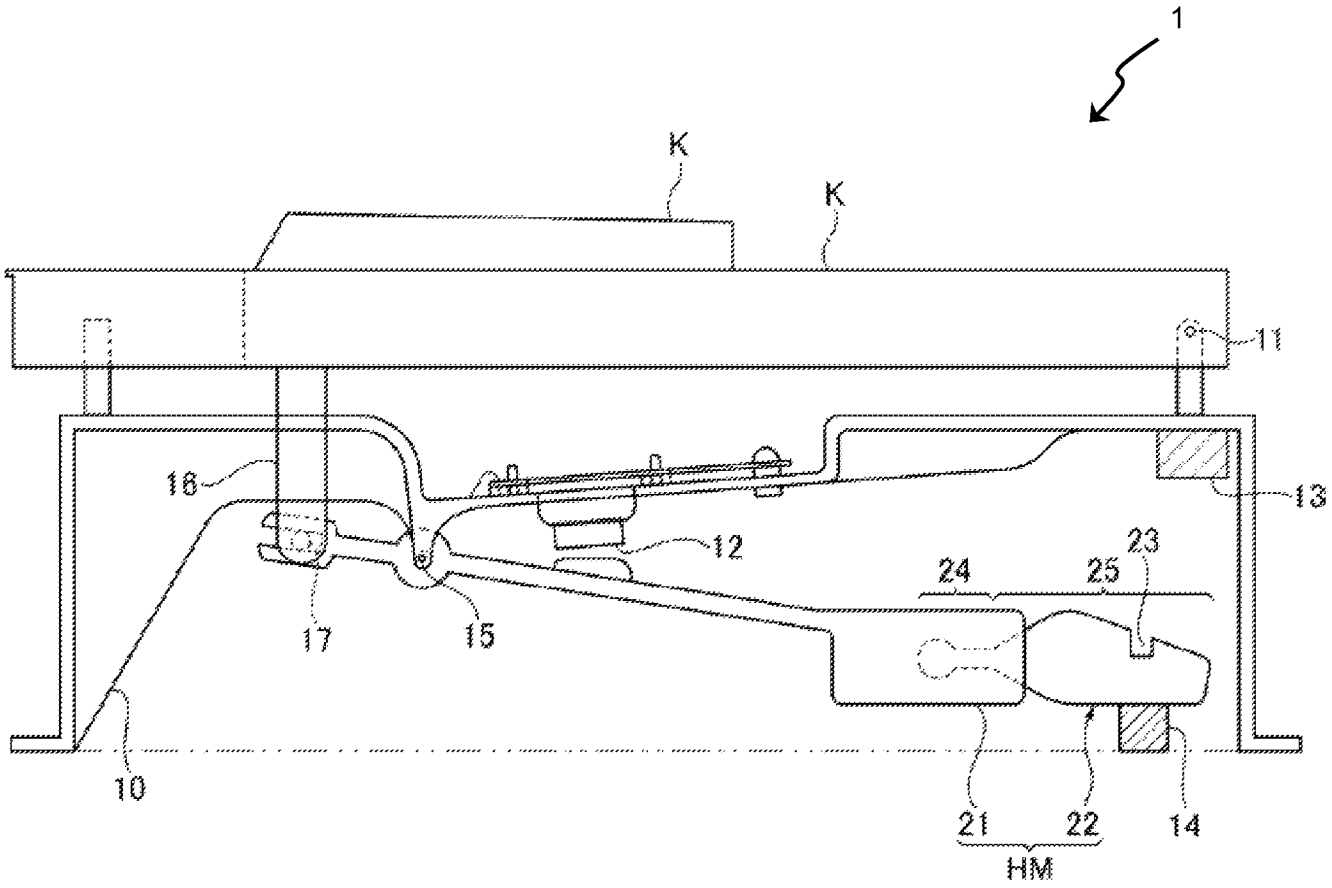
FIG. 1 is a schematic partial cross-sectional view of a keyboard.

FIG. 1 is schematic cross-sectional view of a keyboard 1 according to a first embodiment. The keyboard 1 is applied to an electronic keyboard instrument, for example. FIG. 1 illustrates an undepressed state (state in which a key K and a mass body HM, described further below, are in a pivot start position). Hereinbelow, a rocking-end side of a key in the aforementioned keyboard 1 (free end side) (left side in FIG. 1) is referred to as the front, and the key fulcrum-side (right side in the figure) in the keyboard 1 is referred to as the rear.

The device includes a plurality of keys K (white keys and black keys) that can be depressed, and a plurality of mass bodies HM (keyboard component) corresponding to each of the keys K. Since the configuration corresponding to each of the keys K is basically the same, for the purpose of explanation, unless specifically required, no distinction is made between the white keys and the black keys. A frame 10 is provided on a shelf, which is not shown. A key support point 11 is provided at the rear portion of the frame 10 in correspondence with each key K. Each key K is supported so as to pivot about the corresponding key fulcrum 11.

A hammer pivot fulcrum 15 is provided on the frame 10 in correspondence with each mass body HM. Each mass body HM is a hammer that is supported so as to pivot about the corresponding hammer pivot fulcrum 15. Each key K and the corresponding mass body HM are connected to each other so as to pivot by means of a connecting pin 17. When the operating key K pivots, the corresponding mass body HM pivots in conjunction with the aforementioned key. An upper stopper 13 is provided at the rear portion of the frame 10, and a lower stopper 14 is provided on the shelf. In the undepressed state, the mass body HM strikes the lower stopper 14 due to its own weight, thereby regulating the pivoting start position of the mass body HM. In addition, in the depressed state, the mass body HM strikes the upper stopper 13, thereby regulating the pivoting end position of the mass body HM. When the operation of depressing the key K is released, the mass body HM and the key K return to the pivoting start position in conjunction therewith due to the dead weight of the mass body HM.

In the pivoting stroke from the pivoting start position to the pivoting end position of the mass body HM, the mass body HM presses a switch 12 provided on the frame 10, and the depression operation is thereby detected. Based on this detection result, an unillustrated control unit generates a sound using an unillustrated sound source.

The basic configuration of the mass body HM is common to all the mass bodies HM, and the mass body HM is composed of a first member 21 and a second member 22. As described further below, the shape of the second member 22 can differ for some or all of the mass bodies HM. The second member 22 is formed of metal, or the like, in order to function as a weight. The second member 22 is an integrated member having a unique portion 24 and a common portion 25. A notched portion 23 (described further below) is formed in the common portion 25. On the other hand, the first member 21 is made of resin, which is a material different from metal. When the mass body HM is molded with a mold, the second member 22 is insert-molded inside the first member 21 made of resin by means of simultaneous molding of a resin outsert with respect to the second member 22 as a metal weight, to thereby produce the mass body HM.

Figure 2:
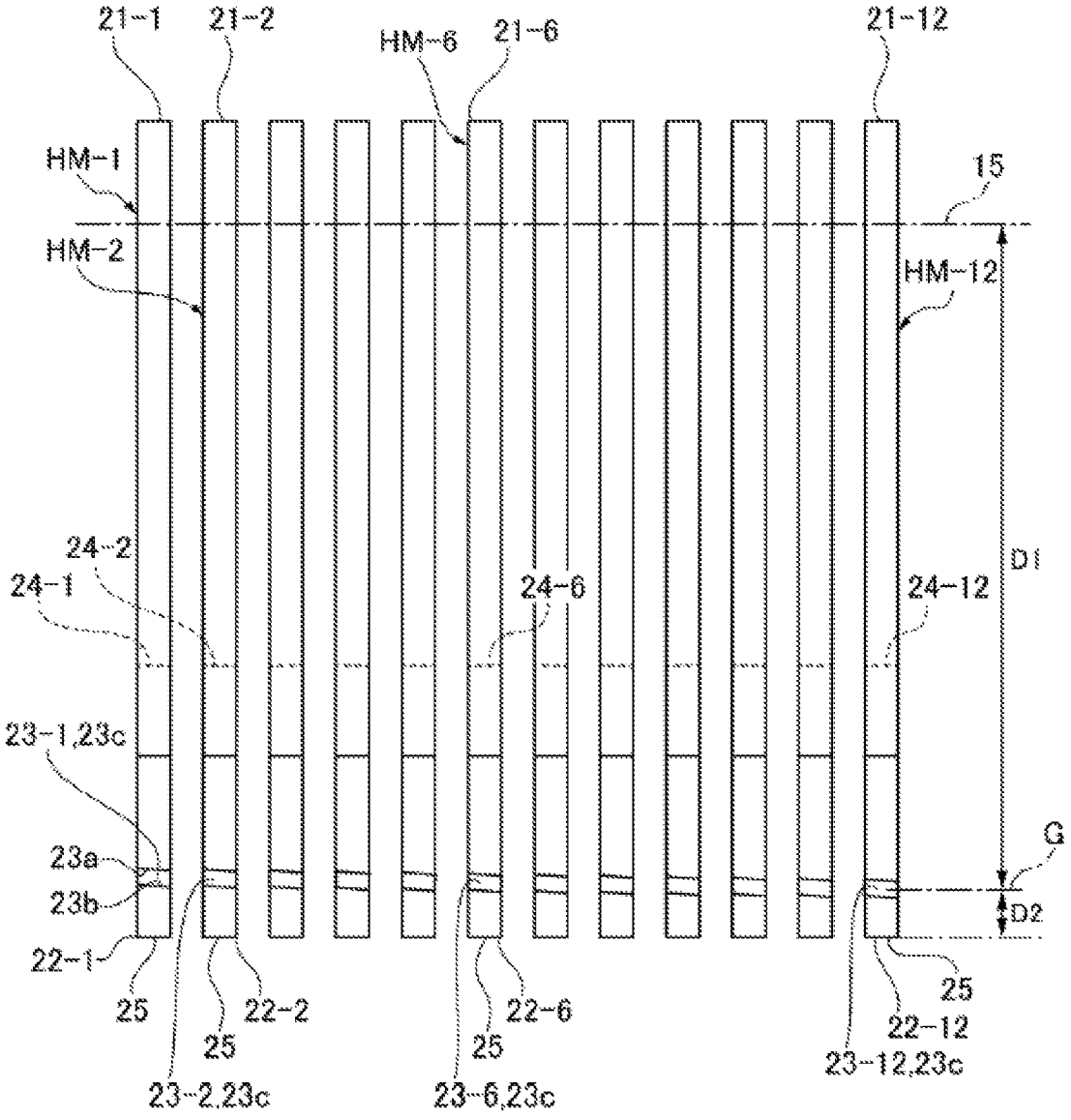
FIG. 2 is a schematic plan view of a plurality of mass bodies.

FIG. 2 is a schematic plan view of a plurality of mass bodies HM arranged parallel to each other in the aforementioned keyboard 1. The area (group) to which a plurality of the mass bodies HM arranged in the aforementioned keyboard 1 belong is divided into a plurality of areas according to key type or sound range. The mass bodies HM in all the groups are arranged such that the hammer pivot fulcrums 15 become concentric, and the rear end positions of the second members 22 are also substantially coincident with respect to each of the mass bodies HM. As an example, FIG. 2 shows twelve mass bodies HM belonging to one area of the plurality of areas classified by one-octave unit. The number and method of division of the areas are not limited. Each of the areas can be classified by a plurality of octaves, or sound range, irrespective of octaves. Alternatively, the division need not be with respect to pitch, and the mass bodies HM can be divided into areas corresponding to a plurality of white keys and areas corresponding to a plurality of black keys.

In FIG. 2, in order from the mass body HM corresponding to the lowest note to the mass body HM corresponding to the highest note in the same group, mass bodies HM-1, HM-2 . . . HM-6 . . . HM-12 are arranged parallel to each other. The notched portions 23 of the mass bodies HM-1, HM-2 . . . HM-6 . . . HM-12 are notched portions 23-1, 23-2 . . . 23-6 . . . 23-12. Similarly, first members 21-1, 21-2 . . . 21-6 . . . 21-12 and second members 22-1, 22-2 . . . 22-6 . . . 22-12 are located in order from the bass side. In addition, unique portions 24-1, 24-2 . . . 24-6 . . . 24-12 are located.

Figure 3:
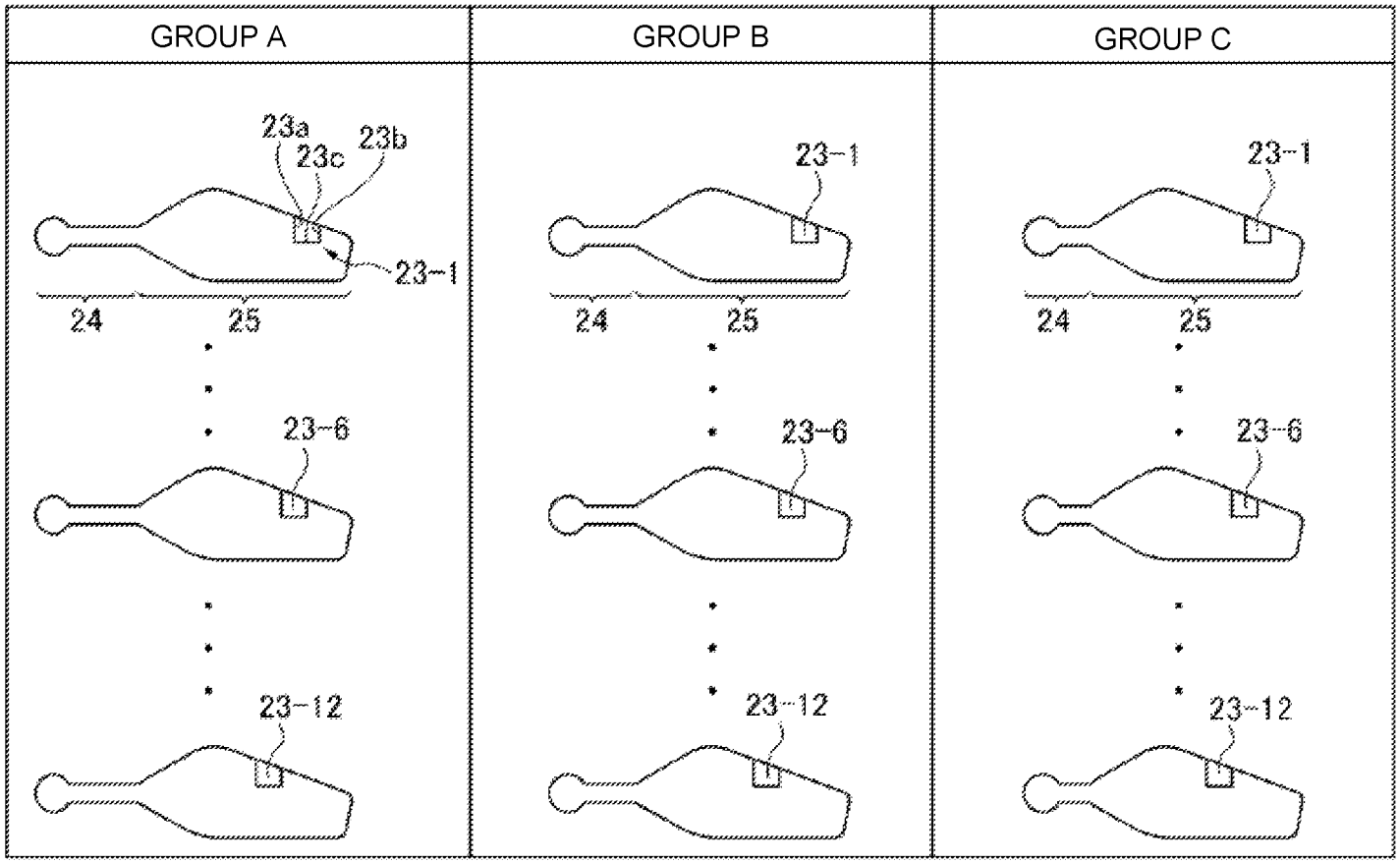
FIG. 3 is a view illustrating differences in the shapes of second members for each area.

FIG. 3 is a view illustrating differences in shape of the second members 22 for each area. In the example of FIG. 3, three groups are shown: group A, group B, and group C. These groups are classified according to sound range, and the sound ranges are in the order of group A<group B<group C, where group C is the highest sound range. The number of groups can also be four or more. For example, FIG. 2 illustrates the group of the mass bodies HM of the group A. In all the groups, the shapes of the common portions 25 of the mass bodies HM are the same if no notched portions 23 are provided. The first member 21 is common to all mass bodies HM. The shape of the unique portion 24 of the mass bodies HM belonging to the same group is the same. The shapes of the unique portions 24 differ for mass bodies HM that belong to different groups.

For example, the length of the unique portion 24 is shorter for the unique portions 24 of the group B than for the unique portions 24 of the Group A, and even shorter for the unique portions 24 of the group C. As a result, the moment of inertia of the mass body HM is lower in groups closer to the treble notes. Due to the differences in the shapes of the unique portions 24, providing gross differences in the moments of inertia for each group is easily achieved. The differences in the shapes of the unique portions 24 is not limited to differences in length, as long as the differences in shape contribute to differences in the moment of inertia.

On the other hand, the setting of minute differences in the moments of inertia within the same group is achieved by the notched portions 23. Regarding the notched portions 23, the shape of the notched portions 23 of the mass bodies HM belonging to the same area is the same, and the positions of the notches (positions of formation) are different from each other. As shown in FIG. 2, all of the notched portions 23 are inclined in plan view. That is, side surfaces 23*a*, 23*b* of each notched portion 23 are inclined such that the treble sides thereof are closer to the rear end side. Since the depth of each notched portion 23 is the same, a bottom surface 23*c* of each notched portion 23 is essentially parallel to the axial direction of the hammer pivot fulcrum 15. In this embodiment, each of the notched portions 23 is unfilled and free of any materials.

The position of the center of gravity G of each notched portion 23 in the longitudinal direction (front-rear direction) of the mass body HM will now be considered. First, distances D1 from the hammer pivot fulcrum 15 to the center of gravity G differ for the mass bodies HM belonging to the same area. In addition, distances D2 from the rear end position of the second member 22 to the center of gravity G differ for the mass bodies HM belonging to the same area. That is, the distance D1 increases as the corresponding pitch increases among the mass bodies HM belonging to the same area, and the distance D2 decreases as the corresponding pitch increases. That is, the notched portion 23 shifts to the rear end side as the corresponding pitch increases. As a result, although the shape of the second member 22 excluding the notched portion 23 is the same within the same group, the moment of inertia is lower in the mass body HM whose corresponding pitch is higher.

Next, the method for manufacturing the keyboard component including the plurality of mass bodies that have notched portions will be described. The method includes forming the notched portions of the plurality of mass bodies such that the notched portions are different from each other in at least one of size or position, or both, and cutting the workpiece.

Figure 4:
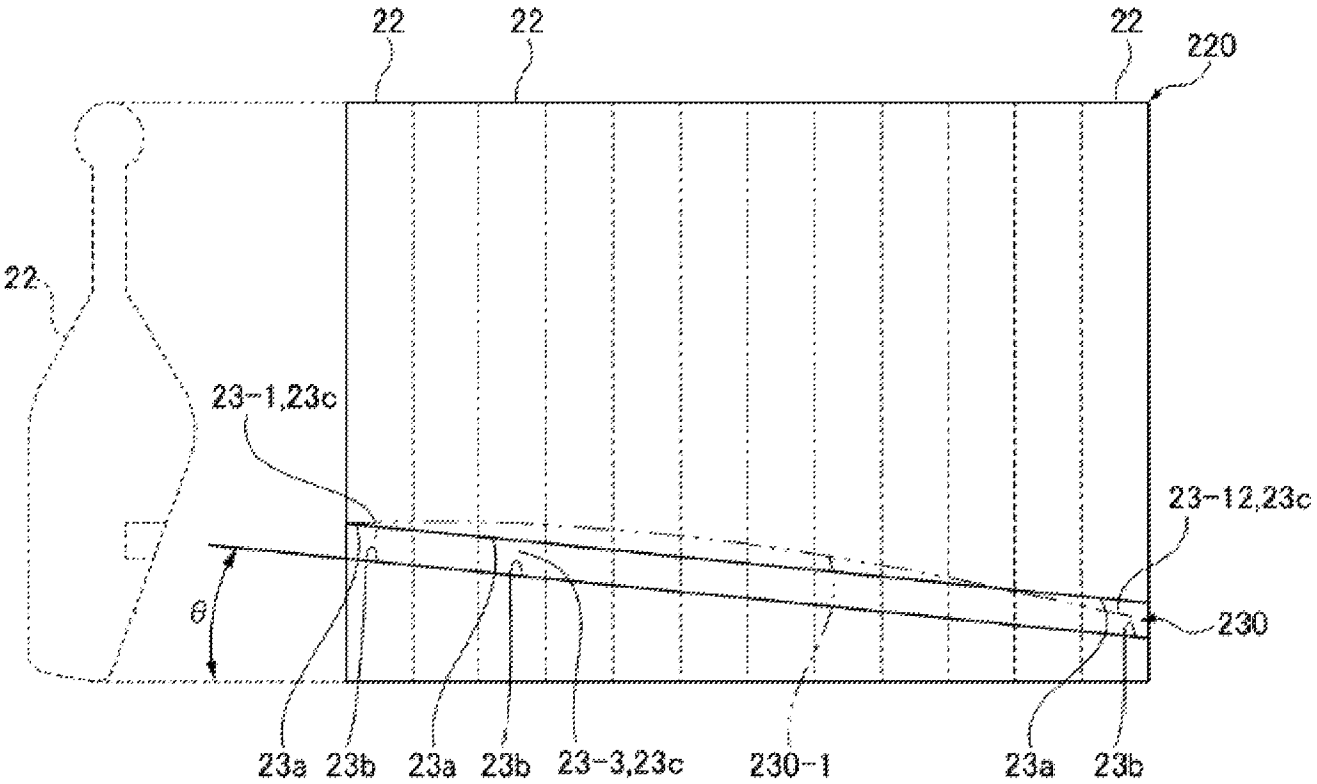
FIG. 4 is a plan view of a workpiece after a notched portion is formed.
Figure 5:
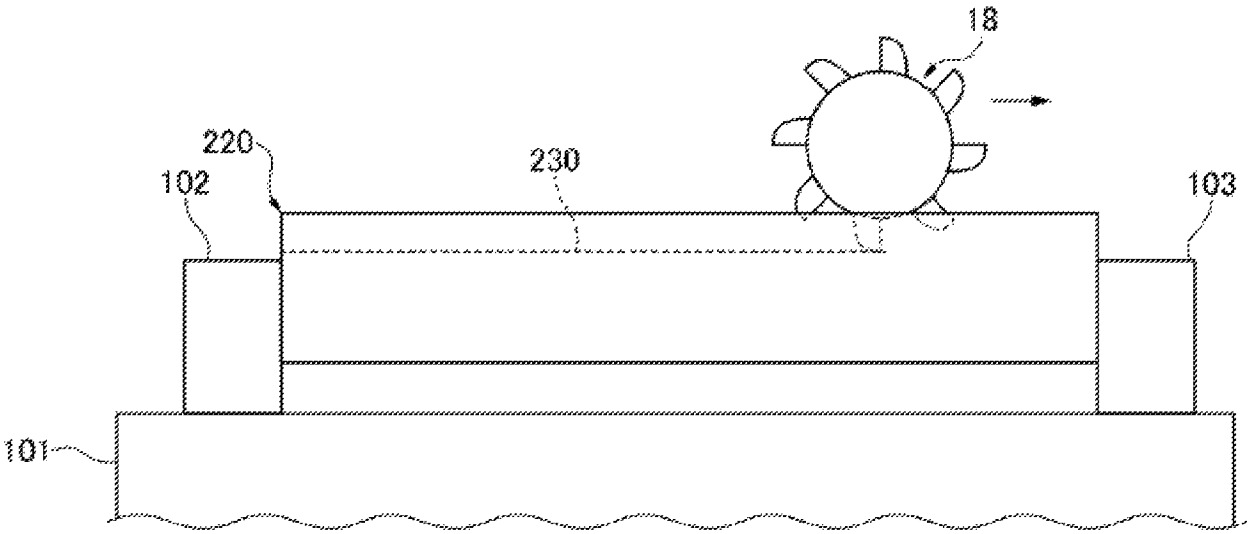
FIG. 5 is a rear view of the workpiece during the formation of the notched portion.

In one example, the method further includes fixing the workpiece to a fixing jig. The forming of the notched portions is performed by forming a groove on the workpiece after the fixing of the workpiece to the fixing jig, and the forming of the groove is performed by moving a cutter relative to the workpiece. After the forming of the groove, the cutting of the workpiece is performed such that the workpiece is cut into the plurality of mass bodies. More specifically, using Group A as an example, the method for manufacturing the second members 22 of the mass bodies HM will be described with reference to FIGS. 4 and 5. FIG. 4 is a plan view of a workpiece 220 after the notched portion 23 has been formed. FIG. 5 is a rear view of the workpiece 220 during the formation of the notched portion 23.

The workpiece 220 is a block-shaped metal member having the same thickness as the total thickness of the second members 22 for one group. Before the workpiece 220 is cut into individual second members 22, an operator forms continuous groove 230 in the workpiece 220 which becomes the notched portions 23. First, as shown in FIG. 5, the operator clamps the workpiece 220 between fixing jigs 102, 103 on a worktable 101. The operator then moves a rotary cutter 18 relative to the workpiece 220 to thereby form the continuous groove 230 in a straight line in the workpiece 220. At this time, as shown in FIG. 4, the operator sets the direction of movement of the cutter 18 such that, in a plan view, the rear end surface of the workpiece 220 and the direction of formation of the continuous groove 230 form an angle θ, and such that the treble side of the continuous groove 230 is inclined toward the rear end side. The rear end surface of the workpiece 220 is essentially parallel to the axial direction of the hammer pivot fulcrum 15 and the arrangement direction of the second members 22, when the mass bodies HM are arranged in the aforementioned keyboard 1.

After forming the continuous groove 230, the operator cuts out a plurality of the second members 22 by cutting the workpiece 220 for each designed thickness of the second member 22. The second members 22 are completed after deburring, and the like. The formation of the notched portions 23 of the second members 22 can essentially be formed all at once by forming one continuous groove 230, which is efficient. Thereafter, as described above, the operator forms the mass body HM by insert-molding the second members 22 in the first member 21

As described above, the notched portions 23 of the plurality of mass bodies HM within the same one of the different areas are configured such that a side surface (23*a*, 23*b*) defining a contour of a notch shape for each of the notched portions 23 is not parallel to an arrangement direction in a state in which the plurality of mass bodies HM within the same one of the different areas are arranged parallel to each other side by side in the arrangement direction with either positions of the common portions 25 being aligned or the pivot fulcrum 15 being concentric among the plurality of mass bodies HM within the same one of the different areas. More specifically, in a state in which the mass bodies HM are arranged in the aforementioned keyboard 1 (FIG. 2), the side surfaces 23*a*, 23*b* from among the constituent surfaces of each notched portion 23 (side surfaces governing the outline of the notch shape) are not parallel to the arrangement direction of the second members 22 or the axial direction of the hammer pivot fulcrum 15. In addition, of the constituent surfaces of each notched portion 23, the bottom surface 23*c* is essentially parallel to the arrangement direction of the second members 22 and the axial direction of the hammer pivot fulcrum 15.

In addition, in a state in which the mass bodies HM are arranged in the aforementioned keyboard 1, the side surfaces 23*a* and the side surfaces 23*b* of the notched portions 23 are substantially parallel but not flush with each other. This is because, although the second members 22 are arranged essentially without intervals in the step preceding their being cut out from the workpiece 220, a prescribed interval is provided between adjacent second members 22 during their arrangement in the aforementioned keyboard 1.

From this standpoint, the above can be expressed as follows. The notched portions 23 of the plurality of mass bodies HM within the same one of the different areas are configured such that the notched portions 23 are aligned to form a continuous path that is not parallel to the arrangement direction in a state in which the plurality of mass bodies HM within the same one of the different areas are removed from the frame 10 and arranged parallel to each other side by side in the arrangement direction with either positions of the common portions 25 being aligned or the pivot fulcrum 15 being concentric among the plurality of mass bodies HM within the same one of the different areas. More specifically, it is assumed that a group of mass bodies HM belonging to the same area (group) are removed from the frame 10 and that the group of mass bodies HM are arranged parallel to each other such that the hammer pivot fulcrums 15 thereof are concentric (or such that the rear end positions of the common portions 25 are coincident). Here, there is a prescribed arrangement mode in which the constituent surfaces (side surfaces 23*a*, 23*b*, bottom surface 23*c*) of each of the notched portions 23 are substantially flush. That the constituent surfaces are "substantially flush" means that the constituent surfaces are included in a common virtual plane and that the surfaces are completely flush. The prescribed arrangement mode in the examples of FIGS. 4 and 5 is an arrangement mode in which the second members 22 are arranged parallel to each other without intervals therebetween. That is, the prescribed arrangement mode is an arrangement mode in which a set of the notched portions 23 and the continuous groove 230 are located. In this arrangement mode, some (side surfaces 23*a*, 23*b*) of the constituent surfaces of the notched portion 23 are not parallel to the arrangement direction of the mass bodies HM (axial direction of the hammer pivot fulcrum 15).

According to the present embodiment, of the plurality of mass bodies HM, the notched portion 23 is formed in each of the mass bodies HM in a range from a pitch greater than or equal to the lowest pitch to the highest pitch, and the positions of the notches of the notched portions 23 differ from each other. First, the mass bodies HM belonging to different areas (groups) have unique portions 24 that have different shapes, as well as common portions 25 which have the same shape if there are no notched portions 23. Differences in the moment of inertia between the mass bodies HM belonging to different areas can be generated as a result of differences in the shapes of the unique portions 24. The positions (D2) of the notches of the notched portions 23 for the group of mass bodies HM belonging to the same area differ from each other (the distances D1 from the hammer pivot fulcrum 15 are different). That is, differences in the moments of inertia between the mass bodies HM belonging to the same area can be generated as a result of differences in the notch positions (D2) of the notched portions 23. Thus, it is possible to easily provide various types of mass bodies HM that have different moments of inertia. Moreover, since the notched portions 23 of the second members 22 can be formed all at once at the stage of the workpiece 220, the manufacturing efficiency is high. Thus, it is possible to facilitate the manufacture of a plurality of the mass bodies HM that have different moments of inertia. It becomes a simple matter to gradually change the moments of inertia of all the mass bodies HM of the keyboard 1 continuously in accordance with the corresponding pitch, and key scaling with a tactile sense of the keying operation is achieved at low cost.

Figure 6:
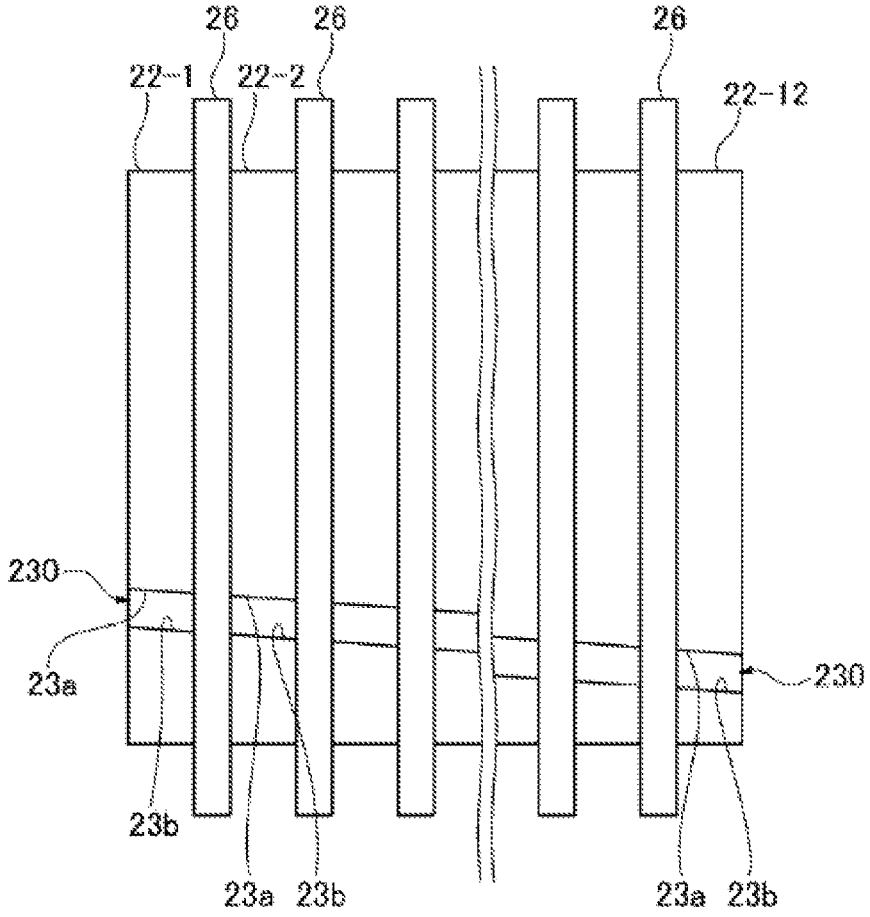
FIG. 6 is a plan view of a plurality of second members for explaining a manufacturing method according to a modified example.

In one example discussed above, after the continuous groove 230 on the workpiece 220 is formed, the workpiece 220 is separated into individual second members 22 by cutting the workpiece 220, but the method for manufacturing the second members 22 is not limited thereby. In a modified example, the method further includes fixing the plurality of mass bodies to a fixing jig after the cutting of the workpiece. More specifically, the workpiece is cut into the plurality of mass bodies, and then the plurality of mass bodies are fixed to the fixing jig. The forming of the notched portions is performed by forming a groove on the plurality of mass bodies that are arranged parallel to each other and fixed to the fixing jig. The forming of the groove is performed by moving a cutter relative to the plurality of mass bodies. FIG. 6 is a plan view of a plurality of the second members 22 for explaining the method for manufacturing the second members 22 according to the modified example. The operator produces one group's worth of the second members 22 in advance by cutting, or the like. Thereafter, in a state in which the rear end positions of the second members 22 are matched and all of the second members 22 are arranged parallel to each other with spacers 26 interposed between adjacent second members 22, the operator clamps the second members 22 in the width direction with the fixing jigs 102, 103. Then, the operator moves the rotary cutter 18 relative to all of the second members 22 to thereby form the linear continuous groove 230 all at once.

If the one group's worth of second members 22 produced in this manner are arranged parallel to each other, maintaining intervals equal to the thickness of the spacer 26 between adjacent second members 22, the constituent surfaces of the notched portions 23 become substantially flush with each other. This arrangement mode corresponds to the prescribed arrangement mode described above.

It is also possible to form the continuous groove 230 in a state in which adjacent second members 22 are brought into contact with each other without using the spacers 26. In this case, if the adjacent second members 22 on which the notched portions 23 are formed are brought into contact with each other and arranged parallel to each other, the constituent surfaces of the notched portions 23 become substantially flush with each other. Thus, considering the manufacturing methods shown in FIGS. 4 and 6 and a manufacturing method that does not use the spacer 26, the efficiency with which the notched portions 23 are formed can be increased when the following condition is satisfied. That is, in the case that adjacent second members 22 are arranged parallel to each other while being brought into contact with each or with prescribed intervals provided therebetween, it is sufficient if there is an arrangement mode in which at least some of the constituent surfaces of the notched portions 23 are substantially flush with each other.

Second Embodiment

A second embodiment will now be described with reference to FIGS. 7 to 9. In the first embodiment, the shape of the notched portions 23 is the same in the group of the mass bodies HM belonging to the same area, but the positions of the notches (positions of formation) differ from each other. In contrast, in the present embodiment, the position of the notched portions 23 is the same in the group of the mass bodies HM belonging to the same area, but the amounts of notching (size) of the notches differ from each other. In particular, depths of the notches differ from each other. In this embodiment, each of the notched portions 23 is unfilled and free of any materials.

Figure 7:
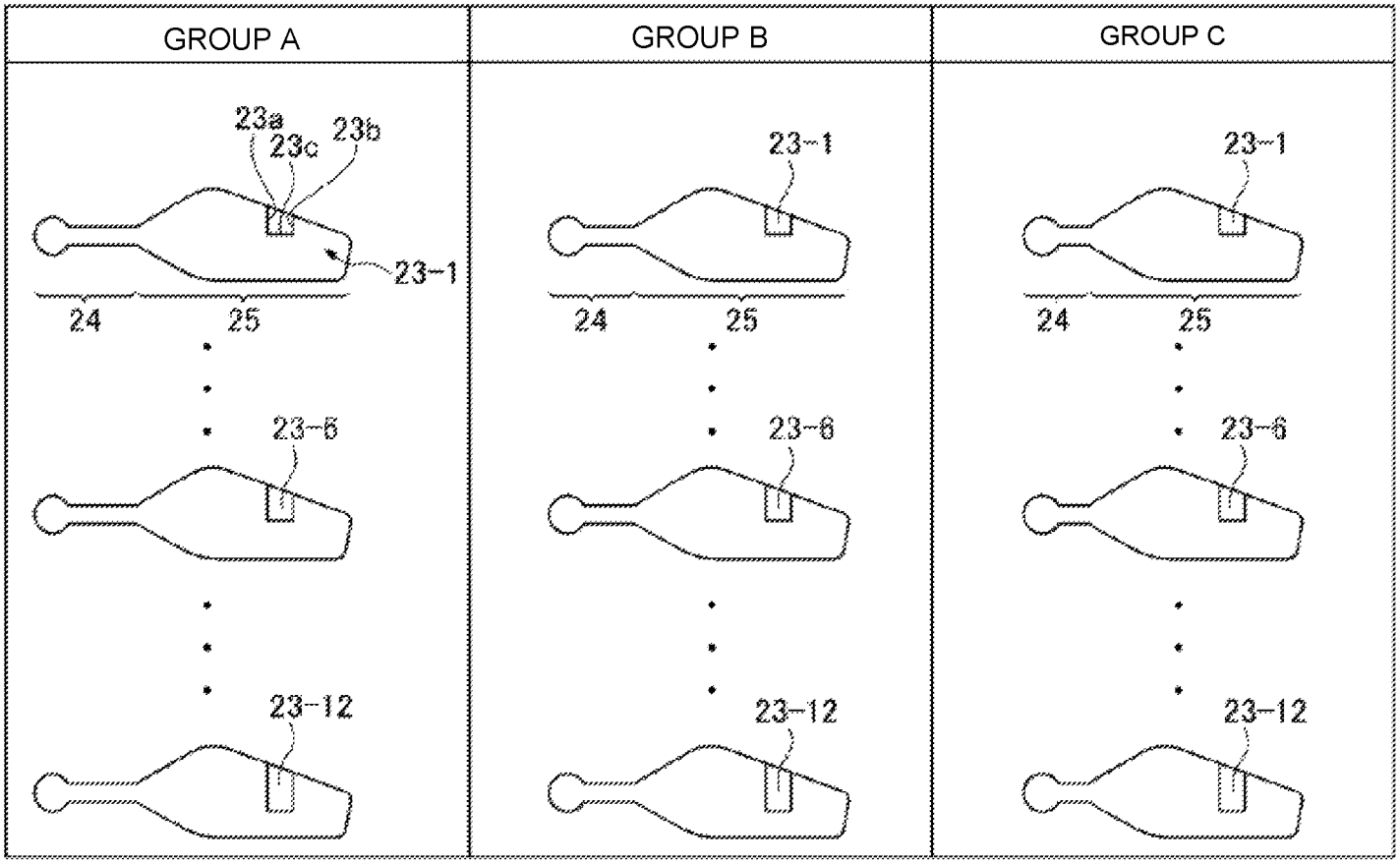
FIG. 7 is a view illustrating differences in the shape of the second members for each area.
Figure 8:
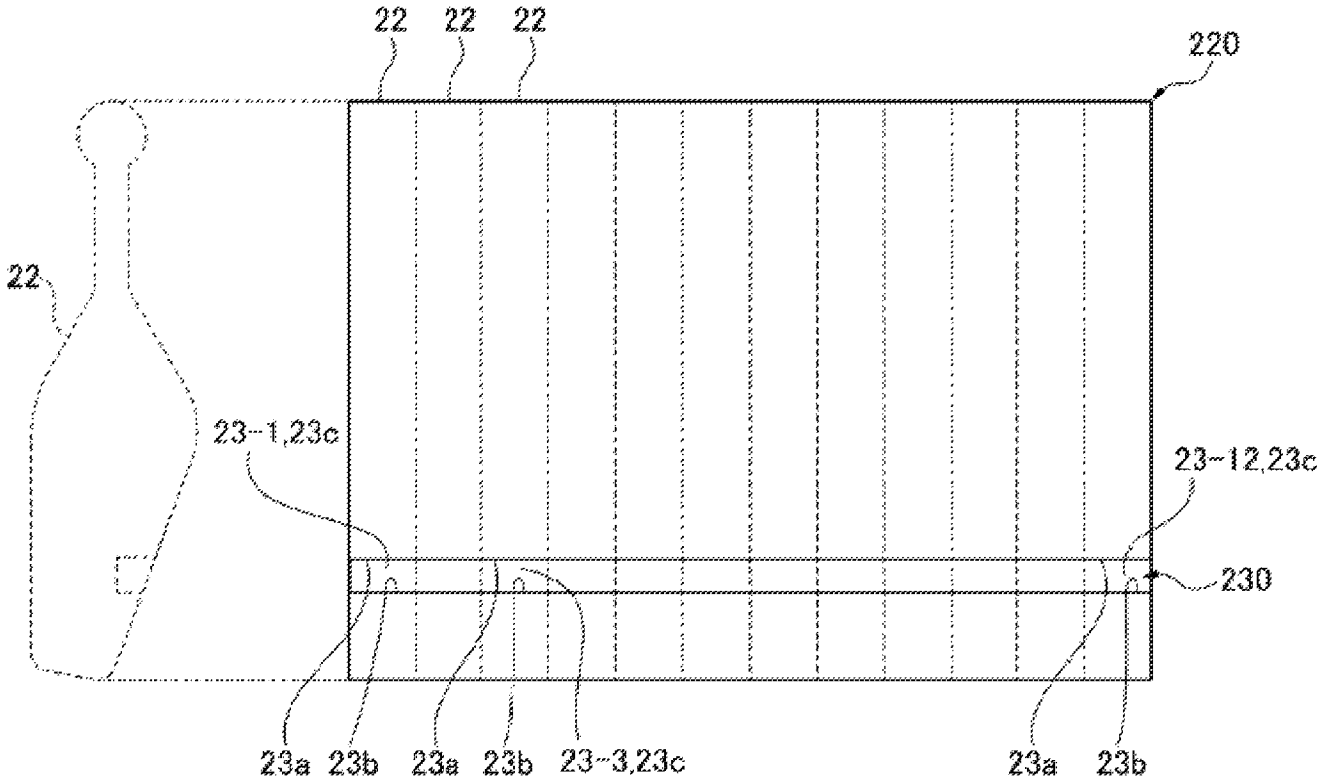
FIG. 8 is a plan view of a workpiece after a notched portion is formed.

FIG. 7 is a view illustrating differences in the shapes of the second members 22 for each area. FIG. 8 is a plan view of the workpiece 220 after forming the notched portions 23. FIG. 9 is a rear view of the workpiece 220 during the formation of the notched portions 23. FIGS. 7, 8, and 9 respectively correspond to FIGS. 3, 4, and 5.

The divisions of the group A, group B, and group C are the same as in the example of FIG. 3. The common portions 25 and the unique portions 24, if there are no notched portions 23, are all the same, as in the first embodiment. Thus, gross differences in the moments of inertia are provided for each group as a result of the differences in the shapes of the unique portions 24. On the other hand, the setting of minute differences in the moments of inertia within the same group is achieved by the amount of notching of the notched portions 23.

First, the distance from the hammer pivot fulcrum 15 to the center of gravity G (corresponding to the distance D1 in FIG. 2) is shared between the mass bodies HM belonging to the same area. The side surfaces 23*a*, 23*b* of each of the notched portions 23 are essentially parallel to the axial direction of the hammer pivot fulcrum 15. The bottom surface 23*c* of each notched portion 23 is inclined such that the treble sides thereof are closer to the lower side. That is, the notched portions 23 are deeper toward the treble side. As a result, although the shape of the second member 22 excluding the notched portion 23 is the same within the same group, the moment of inertia is lower in the mass body HM whose corresponding pitch is higher.

Next, using Group A as an example, the method for manufacturing the second member 22 of the mass body HM will be described with reference to FIGS. 8 and 9. The configuration and the fixing method of the workpiece 220 are the same as in the first embodiment. As shown in FIG. 8, the operator moves the rotary cutter 18 relative to the workpiece 220 to thereby form the continuous groove 230 in a straight line on the workpiece 220. At this time, as shown in FIGS. 8 and 9, the operator sets the direction of movement of the cutter 18 such that the rear end surface of the workpiece 220 and the direction of formation of the continuous groove 230 are parallel, and such that the notch depth becomes deeper toward the treble side. After forming the continuous groove 230, the operator cuts out a plurality of the second members 22 by cutting the workpiece 220 for each designed thickness of the second member 22. The subsequent steps are the same as in the first embodiment.

In a state in which the mass bodies HM are arranged in the aforementioned keyboard 1, the side surfaces 23*a*, 23*b* from among the constituent surfaces of each notched portion 23 are essentially parallel to the arrangement direction of the second members 22 and the axial direction of the hammer pivot fulcrum 15. On the other hand, of the constituent surfaces of each notched portion 23, the bottom surface 23*c* is not parallel to the arrangement direction of the second members 22 or the axial direction of the hammer pivot fulcrum 15.

It is assumed that a group of mass bodies HM belonging to the same area (group) have been removed from the frame 10 and that the group of mass bodies HM have been arranged parallel to each other such that the hammer pivot fulcrums 15 thereof are concentric (or such that the rear end positions of the common portions 25 are coincident). Here, there is a prescribed arrangement mode in which the constituent surfaces (side surfaces 23*a*, 23*b*, bottom surface 23*c*) of each of the notched portions 23 are substantially flush. For example, as in the relationship shown in FIG. 8, if the group of mass bodies HM are arranged parallel to each other without intervals such that the second members 22 are in contact with each other, not only do the side surfaces 23*a*, 23*b* become substantially flush but also the bottom surface 23*c* of each notched portion 23. If the group of mass bodies HM are arranged parallel to each other while prescribed intervals are maintained in the same manner as shown in FIG. 2, the side surfaces 23*a*, 23*b* of each notched portion 23 become substantially flush, but the bottom surfaces 23*c* do not.

According to the present embodiment, differences in the moments of inertia between the mass bodies HM belonging to the same area can be generated as a result of differences in the amount of notching (depths) of the notched portions 23. Thus, it is possible to easily provide various types of mass bodies HM that have different moments of inertia. Moreover, since the notched portions 23 of the second members 22 can be formed all at once at the stage of the workpiece 220, the manufacturing efficiency is high. Thus, the same effect as in the first embodiment can be achieved, with respect to being able to facilitate the manufacture of a plurality of the mass bodies HM that have different moments of inertia.

The continuous groove 230 can be formed after producing one group's worth of the second members 22 in the present embodiments as well, in the same manner as the modified example shown in FIG. 6. At this time, spacers may or may not be used. Regardless of whether spacers are used, in the case that adjacent second members 22 are arranged parallel to each other, as long as the arrangement intervals are appropriately set, there is an arrangement mode in which at least some of the constituent surfaces of the notched portions 23 are substantially flush with each other.

In each of the embodiments described above, the notched portions 23 can be formed in all of the mass bodies HM belonging to the same area in a range from the lowest pitch to the highest pitch. However, it is not necessary for the notched portions 23 to be formed in all of the mass bodies HM belonging to the same area. For example, the notched portion 23 can be formed in each of the mass bodies HM in a range from a pitch greater than or equal to the lowest pitch of the same area to the highest pitch of the same area. Thus, notched portions 23 need not be present in a prescribed number of mass bodies HM beginning with the first mass body on the bass side.

Figure 10:
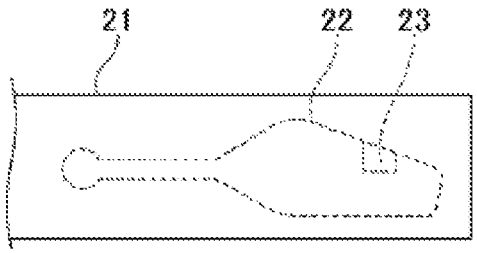
FIG. 10 is a partial side view of a mass body according to a modified example.
Figure 11:
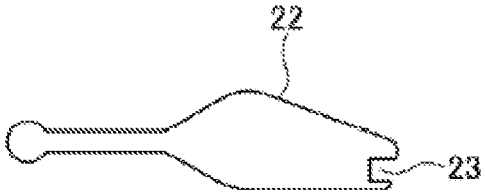
FIG. 11 is a side view of the second member according to a modified example.
Figure 12:
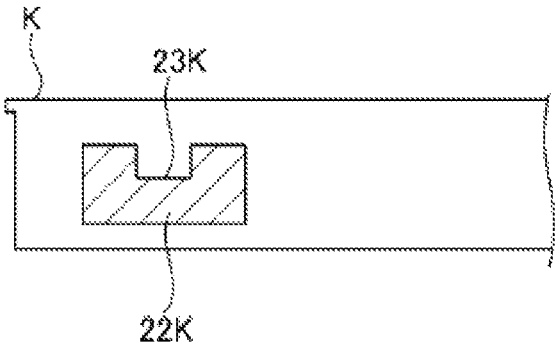
FIG. 12 is a partial side view of a key in which the second member is embedded.

In addition, various modified examples as shown in FIGS. 10 to 12 are conceivable. FIG. 10 is a partial side view of the mass body HM according to a modified example. As a result of forming the entire second members 22 so as to be embedded inside the first member 21, the notched portion 23 is not exposed. The notched portion 23 is covered with a resin member, which contributes to corrosion prevention and increased durability. Insert molding was given as an example of a means to incorporate the second member 22 in the first member 21, but the invention is not limited thereto, and any method, such as fitting, can be used. In addition, in the present embodiment, the first member 21 and the second member 22 are separate members, but the mass body HM can be configured as a single body. In addition, the material of the first member 21 is resin, and the material of the second member 22 is metal, but the materials are not limited thereto.

As in the second member 22 illustrated in FIG. 11, the direction of the opening of the notched portion 23 is not limited to the upward direction, and can be the forward, rearward, or downward direction. In addition, the shape of the notched portion 23 in a side view is not necessarily required to be shaped semi-rectangular, and can be C-shaped, U-shaped, arcuate, or polygonal. In addition, the notched portion 23 can be understood to be a groove or a hole. The notched portion 23 is not limited to being formed only on in the common portion 25, and can be formed over a part of the unique portion 24 or a part of the first member 21. In addition, a method was described in which the notched portions 23 are formed by cutting a workpiece with a rotary cutter, but the invention is not limited thereto. For example, when holes of different size are formed as the notched portions 23, the notched portions 23 can be formed by a desired method, such as boring holes in the workpiece with a drill.

Figure 9:
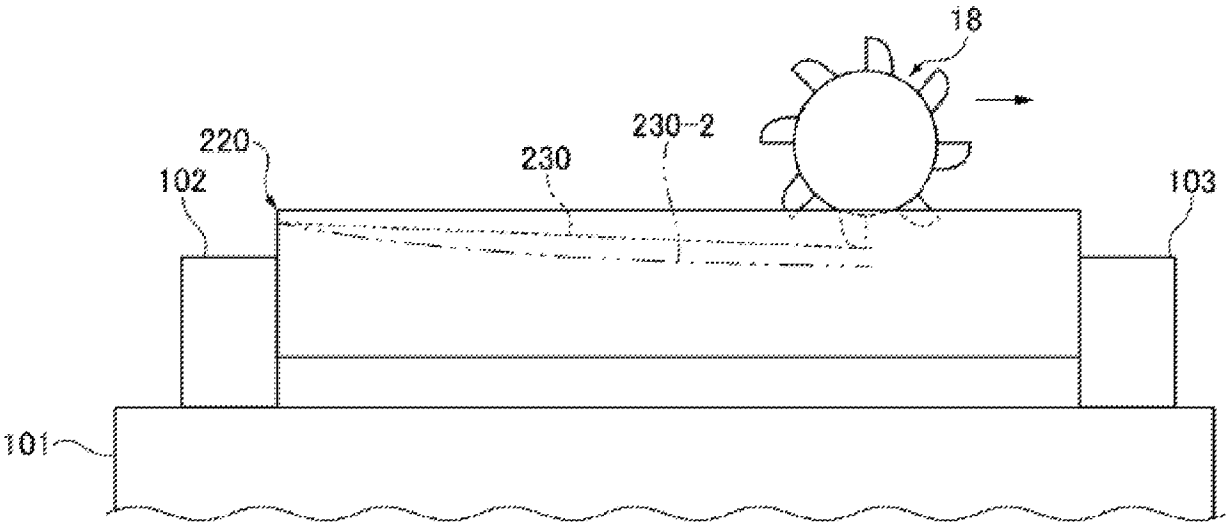
FIG. 9 is a rear view of the workpiece during the formation of the notched portion.

In the examples shown in FIGS. 4 and 9, an example was presented in which the moments and mass are changed by linearly changing position and depth, but such linear changes are not essential. For example, as shown by the double-dot chain lines 230-1 and 230-2 in FIGS. 4 and 9, the position and depth can be changed in a curvilinear manner. The double-dot chain line 230-1 in FIG. 4 shows an example of the positions of the side surfaces 23*a* of the notched portions 23. That is, the arrangement mode in which at least some of the constituent surfaces of each of the notched portions do not become parallel to the arrangement direction of the group of the mass bodies, and the mode in which the side surfaces governing the contour of the notch shape of the notched portion do not become parallel to the arrangement direction are not limited to a plane-to-plane relationship, but also include a plane-to-curved surface relationship, or a curved surface-to-curved surface relationship.

In the embodiments described above, the mass bodies belonging to different areas among the plurality of areas have unique portions that have different shapes from each other, as well as common portions that have the same shape if there are no notched portions, but the configuration may be one in which there is no distinction between a unique portion and a common portion.

According to the embodiments described above, a keyboard 1 includes a frame 10, a plurality of keys K, and a plurality of hammers HM. The plurality of keys K are arranged in parallel to each other and pivotally supported with respect to the frame 10 about a key pivot fulcrum 11. The plurality of hammers HM are arranged in parallel to each other and pivotally supported with respect to the frame 10 about a hammer pivot fulcrum 15. The plurality of hammers MC are connected to the plurality of keys K to pivot in conjunction with a corresponding one of the plurality of keys K on a one-to-one basis to define a plurality of key-hammer arrangements arranged in parallel to each other. At least some of the plurality of key-hammer arrangements include notched portions 23 being arranged in order from a pitch, which is equal to or greater than a lowest pitch, to a highest pitch. The notched portions 23 are different from each other in at least one of size, position, distance from the key pivot fulcrum 11, or distance from hammer pivot fulcrum 15.

It is not necessary that the second member 22, which functions as a weight, be applied to the mass body HM that moves in conjunction with an operation of the key K. As shown in FIG. 12, a mass body in which a second member 22K, on which a notched portion 23K (embedded member) is formed, is embedded in the key K that is directly operated, can be the mass body of this disclosure. In this case, it is not necessary to provide the mass body HM that is interlocked with the key K. In addition, a hammer was described as an example of an interlocking member that moves in conjunction with the key K, but other members can be used. Thus, the mass body HM can be a plurality of the keys K that are directly operated, a plurality of interlocking members that pivot in conjunction with the corresponding key K, or embedded in such keys or interlocking members (embedded members in the plurality of keys or embedded members in the plurality of interlocking members).

When this disclosure is applied, the "keyboard" includes at least a plurality of the keys K, but can also include a plurality of the mass bodies HM. In addition, the "keyboard" can be called a keyboard device or a keyboard unit.

This disclosure was described above based on preferred embodiments, but this disclosure is not limited to the above-described embodiments, and includes various embodiments that do not depart from the scope of the invention. Some of the above-described embodiments may be appropriately combined.

What is claimed is:

1. A keyboard comprising:

a frame; and a plurality of mass bodies arranged in parallel to each other, each of the plurality of mass bodies being pivotally supported to pivot about a pivot fulcrum with respect to the frame, the plurality of mass bodies being at least one of a plurality of keys configured to be directly operated, a plurality of interlocking members configured to pivot in conjunction with a corresponding one of the plurality of keys, embedded members in the plurality of keys or embedded members in the plurality of interlocking members, at least some of the plurality of mass bodies including notched portions being arranged in order from a pitch, which is equal to or greater than a lowest pitch, to a highest pitch, and the notched portions being different from each other in at least one of size, position, or distance from the pivot fulcrum.

2. The keyboard according to claim 1, wherein the plurality of mass bodies are divided into different areas classified according to key type or sound range, each of the plurality of mass bodies has a unique portion and a common portion, the unique portions have shapes that are different from each other between the different areas but identical within a same one of the different areas, the common portions have shapes that are identical to each other in the different areas except for the notched portions being different within the same one of the different areas, and the notched portions are arranged in order from the pitch, which is equal to or greater than the lowest pitch of the same one of the different areas, to the highest pitch of the same one of the different areas.

3. The keyboard according to claim 2, wherein the plurality of mass bodies have moments of inertia that are different from each other between the different areas as a result of differences in the shapes of the unique portions.

4. The keyboard according to claim 2, wherein the notched portions are formed in the common portions of the plurality of mass bodies that include the notched portions.

5. The keyboard according to claim 2, wherein each of the notched portion has a center of gravity spaced from the pivot fulcrum by a distance that increases as a corresponding pitch increases for a group of the plurality of mass bodies within the same one of the different areas.

6. The keyboard according to claim 2, wherein the size of each of the notched portions increases as a corresponding pitch increases for a group of the plurality of mass bodies within the same one of the different areas.

7. The keyboard according to claim 2, wherein the notched portions are filled with a material different from a material forming the common portions.

8. A keyboard component comprising:

a plurality of mass bodies, which are at least one of a plurality of keys configured to be directly operated, a plurality of interlocking members configured to pivot in conjunction with a corresponding one of the plurality of keys, embedded members in the plurality of keys or embedded members in the plurality interlocking members, the plurality of mass bodies being divided into different areas classified according to key type or sound range, each of the plurality of mass bodies having a unique portion and a common portion, the unique portions having shapes that are different from each other between the different areas but identical within a same one of the different areas, the common portions having shapes that are identical to each other in the different areas except for if a notched portion is provided in the common portions, at least some of the plurality of mass bodies having notched portions within the same one of the different areas being arranged in order from a pitch, which is equal to or greater than a lowest pitch of the same one of the different areas, to a highest pitch of the same one of the different areas, and the notched portions of the plurality of mass bodies within the same one of the different areas being configured such that a side surface defining a contour of a notch shape for each of the notched portions is not parallel to an arrangement direction in a state in which the plurality of mass bodies within the same one of the different areas are arranged parallel to each other side by side in the arrangement direction with either positions of the common portions being aligned or the pivot fulcrum being concentric among the plurality of mass bodies within the same one of the different areas.

9. The keyboard component according to claim 8, wherein the notched portions of the plurality of mass bodies within the same one of the different areas is configured such that the notched portions have a prescribed arrangement in which constituent surfaces forming each of the notched portions of the mass bodies within the same one of the different areas become aligned with each other and in which at least some of the constituent surfaces of each of the notched portions of the mass bodies within the same one of the different areas are not parallel to the arrangement direction.

10. A keyboard comprising:

a frame; and the keyboard component according to claim 8, each of the plurality of mass bodies being pivotally supported to pivot about a pivot fulcrum with respect to the frame, the notched portions of the plurality of mass bodies within the same one of the different areas being configured such that the side surface is not parallel to the arrangement direction in a state in which the plurality of mass bodies within the same one of the different areas are removed from the frame and arranged parallel to each other side by side in the arrangement direction with either positions of the common portions being aligned or the pivot fulcrum being concentric among the plurality of mass bodies within the same one of the different areas.

11. A method for manufacturing a keyboard component including a plurality of mass bodies that have notched portions from a workpiece, the method comprising:

forming the notched portions for the plurality of mass bodies such that the notched portions are different from each other in at least one of size or position, or both; and cutting the workpiece, wherein the forming of the notched portions is performed by forming a groove on the workpiece, the forming of the groove is performed by moving a cutter relative to the workpiece, and the cutting of the workpiece is performed such that the workpiece is cut into the plurality of mass bodies after the forming of the groove.

12. The method for manufacturing the keyboard component according to claim 11, further comprising fixing the workpiece to a fixing jig, wherein the forming of the notched portions is performed by forming the groove on the workpiece after the fixing of the workpiece to the fixing jig.

13. A method for manufacturing a keyboard component including a plurality of mass bodies that have notched portions from a workpiece, the method comprising:

forming the notched portions for the plurality of mass bodies such that the notched portions are different from each other in at least one of size or position, or both; and cutting the workpiece, wherein the cutting of the workpiece is performed such that the workpiece is cut into the plurality of mass bodies, the forming of the notched portions is performed by forming a groove on the plurality of mass bodies that are arranged parallel to each other, and the forming of the groove is performed by moving a cutter relative to the plurality of mass bodies that are arranged parallel to each other.

14. The method for manufacturing the keyboard component according to claim 13, further comprising fixing the plurality of mass bodies to a fixing jig after the cutting of the workpiece, wherein the forming of the notched portions is performed by forming the groove on the plurality of mass bodies after the fixing of the plurality of mass bodies to the fixing jig.

* * * * *